United States Patent [19]

Nelson

[11] 4,280,793

[45] Jul. 28, 1981

[54] BORE HOLE PUMPS

[75] Inventor: Hugh D. Nelson, Sydney, Australia

[73] Assignee: Mono Pumps Limited, Audenshaw, England

[21] Appl. No.: 14,478

[22] Filed: Feb. 23, 1979

[30] Foreign Application Priority Data

Feb. 23, 1978 [AU] Australia ..... 07344/78

[51] Int. Cl.[3] ..... F04D 29/54

[52] U.S. Cl. ..... 415/199.5; 415/219 R; 417/448

[58] Field of Search ..... 417/360, 448, 361; 415/199.5, 219 R, 201, 501; 166/105, 208, 241; 308/4 A

[56] References Cited

U.S. PATENT DOCUMENTS

| | | | |
|---|---|---|---|
| 1,547,371 | 7/1925 | Emerson | 415/501 X |
| 1,772,862 | 8/1930 | Gerhard | 415/199.5 |
| 1,795,552 | 3/1931 | Getty | 415/501 X |
| 1,997,880 | 4/1935 | Watry | 308/4 A |
| 2,080,683 | 5/1937 | Yost et al. | 415/501 X |
| 2,530,673 | 11/1950 | Zinszer | 166/105 |

*Primary Examiner*—Leonard E. Smith

*Attorney, Agent, or Firm*—Fleit & Jacobson

[57] ABSTRACT

A bore hole pump assembly and a method of forming the bore hole assembly, wherein a pump casing member has connected thereto a plurality of interconnectable bore hole lining pipes, with the lowermost of said pipes being connectable directly to one axial end of the casing member, a turbine pump having a plurality of axially spaced turbine impellers with a plurality of bowl elements interposed between the impellers each provided with fixed vanes thereon, and a drive shaft at one axial end of the pump and a tubular housing at the other axial end of the pump, the housing being engageable in the pump casing member and being removable by movement towards said one axial end, the lining pipes acting as a discharge pipe of the pump.

7 Claims, 2 Drawing Figures

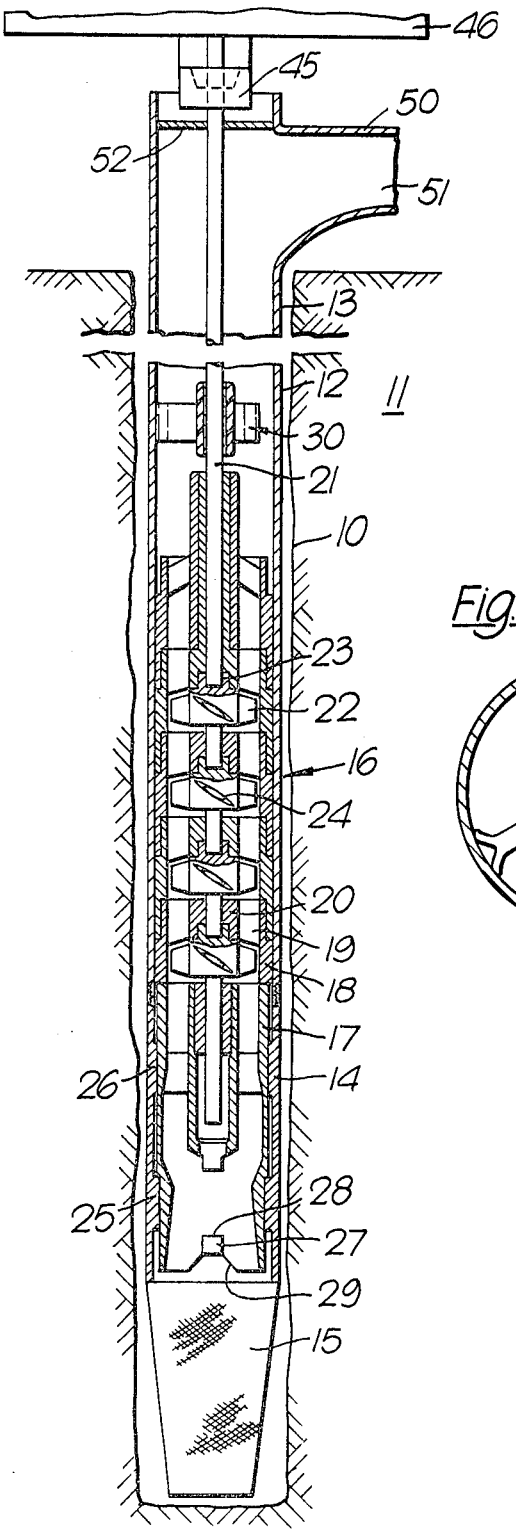
Fig. 1.
Fig. 2.
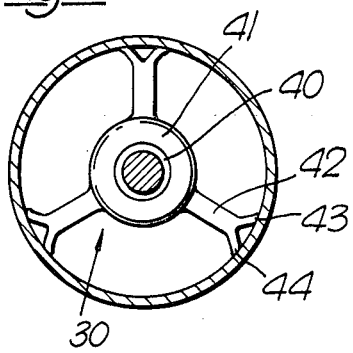

BORE HOLE PUMPS

The present invention relates to a bore hole pump assembly and to a method of providing a bore hole pump.

It is conventional to provide bore hole pumping arrangements by drilling a bore hole, passing a lining pipe into this bore hole to prevent the earth collapsing back into the bore hole, and then the pump itself is lowered downwardly through this lining. The pump may take many forms such as a helical gear pump or an axial flow turbine pump and it is lowered into the bore hole by successively adding discharge pipe sections and drive shaft sections and lowering these in turn down into the lining. A drive motor or engine is provided at the surface and this rotates the drive shaft which drives the pump elements.

When it is desired to carry out some servicing on the pump, the drive shaft is disconnected from the motor or engine and the discharge pipe and drive shaft are pulled up, being disassembled into their several lengths as they are pulled out.

It is now proposed, according to the present invention, to provide a bore hole pump assembly comprising a pump casing member, a plurality of interconnectable bore hole lining pumps, the lowermost of said pipes being connectable directly to one axial end of the casing member, a turbine pump having a plurality of axially spaced turbine impellers and a plurality of bowl elements interposed between the impellers each provided with fixed vanes thereon, a drive shaft at one axial end of the pump and a tubular housing at the other axial end, the housing being non-rotatably engageable in the pump casing member and being removable by movement towards said one axial end, the lining pipes acting as the discharge pipe of the pump.

Such an assembly has several advantages. Firstly, it dispenses with the necessity for providing both a bore hole lining pipe and a pump discharge pipe, since the bore hole lining pipe acts as the discharge pipe for the pump. This gives a very substantial reduction in the overall cost of the bore hole installation. Secondly, when it is intended to service the pump, all that one has to do is to disconnect the upper end of the drive shaft from its motor or engine, and to pull this up, this action pulling the pump housing away from the pump casing member and thereby pulling the whole pump out. The real advantage here is that one does not have to disconnect the discharge pipe sections as has hitherto been necessary.

The casing member is preferably provided with two axially spaced internal seating surfaces, and the tubular housing is provided with two axially spaced external seating surfaces co-operating with the internal seating surfaces to align the housing within the casing. These seating surfaces are advantageously cylindrical and the diameter of the seating member remote from the one axial end of the pump (that is to say the lower seating surface) is smaller than that of the upper seating surface so that one can readily insert and remove the pump from the pump casing member.

With such a construction, the pump casing member is preferably provided with a radially inwardly extending lug and the tubular housing is provided, at its lower end, with a notch co-operable with the lug to prevent rotation of the housing and the bowl elements, and the notch may have a flared lead-in portion to facilitate the insertion of the lug into the notch. The arrangement should be such that the lug and notch are so positioned to ensure that the seating surfaces are engaged with one another when the notch is engaged with the lug.

A drive shaft is pivotably connected to a drive motor or engine by a connector such as a collet connector, which enables the axial position of the pump rotor to be adjusted simply by lifting the drive shaft up slightly and clamping the collet or other adjustable connector.

The invention also relates to a method of providing a bore hole pump, comprising boring a hole into the ground, assembling a pump casing member onto the lowermost pipe section of a bore hole lining pipe, inserting the casing member and the lining pipe section into the bore hole, adding further lining pipe sections to said lowermost lining pipe section and continuing to insert the thusformed assembly into the bore hole to the desired depth, passing into the lining pipe an axial flow turbine pump having a plurality of axially spaced rotatable axial flow turbine impellers and a plurality of bowl elements interposed between the impellers each provided with fixed vanes thereon, and a drive shaft at the upper axial end of the pump and a tubular housing at the other axial end of the pump, so that the tubular housing member is introduced first into the lining member, adding drive shaft sections and continuing to lower the axial flow pump into the lining, until the tubular housing member engages in the pump casing member.

Preferably the drive shaft is raised slightly, after installation and is then clamped e.g. by a collet connection, into the drive motor so that the axial loading of the pump rotor element is removed.

Advantageously the drive shaft is provided with bearing elements, which are axially spaced along the drive shaft length, these bearings each comprising a hub having an axial bore therethrough for the passage of the drive shaft, a plurality of arms extending outwardly from said hub and two fingers on the end of each arm remote from the hub, the fingers diverging one on each circumferential side of the axial plane of the associated arm, the bearing means being dimensioned such that the fingers engage the inner wall surface of an adjacent bore hole lining pipe.

With this arrangement the bearing can have such a dimension that it is a sliding fit in the bore hole lining pipe and will be readily insertable thereinto. Having inserted it in place, when the motor or engine is started up and the drive shaft rotates, there will be a tendency for one of the two fingers, depending on which direction of rotation is taking place, to engage firmly against the inner wall of the lining pipe, so that the bearing is accurately centred in the pipe.

In order that the invention may more readily be understood, the following description is given, merely by way of example, reference being made to the accompanying drawings, in which:

FIG. 1 is a schematic cross-section through one embodiment of bore hole pump assembly according to the invention; and FIG. 2 is a top plan view illustrating the bearing assembly for mounting the drive shaft in the bore hole lining.

Referring first to FIG. 1, there is illustrated a bore hole 10 formed in the ground 11, this having extending within the bore 10 a lining pipe made up of a plurality of sections 12 which are threaded one onto the other. In the drawing only one lower section 12 has been shown and this is connected, via a large number of other sections to the top section 13 which serves to connect the bore hole lining to the prime mover, that is to say an electric motor or an internal combustion engine or the like, which is not shown in the drawing. The lower end of the section 12 which is shown has secured thereto, as by threading, a tubular pump casing 14. At the bottom end of this pump casing 14 a conventional filter or strainer 15 is provided and secured in the normal way.

An axial flow turbine impeller pump indicated by the general reference numeral 16 is slid downwardly into the bore hole lining pipe and this pump consists of a lower pump stator housing 17, and a series of stator bowls 18 stacked on top of the housing 17, the bowls having a number of vanes 19 extending inwardly to a hub member 20. A shaft 21 has mounted thereon an axial flow turbine rotor comprising impellers 22 which are interposed between adjacent bowls 18, the impellers 22 having hubs 23 interfitting with the hubs 20 and also having blades 24 which project fluid to be pumped vertically upwardly, with the assistance of the vanes 19.

The pump casing is provided with lower and upper internal cylindrical bearing surfaces 25 and 26, the diameter of the bearing surfaces 25 being less than that of the bearing surface 26. The pump housing 17 has cylindrical surfaces of diameters to co-operate with these surfaces 25 and 26.

A lug 27 extends radially inwardly from one portion of the wall of the casing 14 and this is engageable in a notch 28 which has a flared opening 29 in the housing 17.

The drive shaft 21 is mounted centrally within the bore by a number of bearing elements 30 only one of which can be seen in FIG. 1. This bearing element is shown in greater detail in FIG. 2. In essence it comprises a hub portion 40 embedded in a resilient plastics material 41, and having three equiangularly spaced arms 42 each having a pair of fingers 43 and 44 diverging on opposite circumferential sides of a radial plane which is the plane of symmetry of the respective arm 42. Such a structure is made so that it is a sliding fit in the bore hole lining pipe and, in use, when the shaft rotates, the hub 40 will tend to rotate in the appropriate direction and the respective one of the fingers 44 or 43 of each arm will be forced into tighter engagement with the wall of the bore lining pipe.

At the upper end, the drive shaft 21 is provided with a collet connector 45 which includes two parts with co-operating tapering surfaces which enables the drive shaft 21 to be clamped axially to the motor shaft. The upper of these two connector parts is rotatable by a motor 46 which has been shown very schematically.

In order to install the assembly of the present invention, the bore hole 10 is bored, in the usual manner, and thereafter the strainer 15 is fitted onto the pump casing member 14 and the first of the bore lining sections 12 is secured to the upper end of the pump casing 14. The thus formed assembly is introduced into the top of the bore hole and lowered, and further pipe sections are added progressively until the full length of the bore hole lining is complete and the strainer 15 is at the bottom of the bore hole.

With this arrangement in place, an outlet duct 50 is connected to the uppermost one of the bore hole lining pipe sections, this having a discharge outlet 51. The pump itself which has been preassembled is taken and the first or the first few drive shaft sections 21 are connected to it. The rotary pump elements or impellers 22 are momentarily immobilised with respect to the bowls 18 by introducing a frangible element, such as a small piece of wood, into the top part of the pump 16.

The pump is then lowered by means of the drive shaft into the bore hole lining and further drive shaft sections are fitted until the bottom edge of the housing 17 engages the lug 27. The drive shaft is then rotated by the necessary amount for the housing to be rotated until the flared lead-in 29 of the notch 28 engages the lug. The pump housing, and therefore the drive shaft will then be able to drop downwardly a little further until the pump takes up the position illustrated in the drawing with the lug fully engaged in the notch and the pump housing thereby held against rotation.

While the pump is being lowered, and additional drive shaft sections added these sections have fitted thereover the bearing elements 30 at appropriate axially spaced locations. The bearing has an outside dimension which allows it to slide freely within the bore but, as indicated above, when the pump drive shaft is rotated, one of the fingers of each arm is pressed firmly against the inner wall of the bore liner pipe.

With the notch 28 fully engaged on the lug 27, the housing itself is in the final position. The fitter then grasps the drive shaft and pulls it upwardly by an amount of say 5 mm. This will have the effect of lifting the rotor impellers slightly off the bowl members and will remove substantially all axial loading in the location of the pump. If the collect connector 45 is then tightened up, this condition will be maintained. A top plate 52 may then be added and the assembly is then complete.

We claim:

1. A bore hole pump assembly comprising a pump casing member having first and second ends; a plurality of interconnectable bore hole lining pipes, the lowermost of said pipes being connectable directly to said first axial end of the pump casing member; a turbine pump having a plurality of axially spaced turbine impellers and a plurality of stator bowl elements interposed between said impeller and each bowl element provided with fixed vanes thereon; a drive shaft at one axial end of the pump; a tubular housing at the other axial end of the pump; a radially inwardly extending lug on said pump casing member; means defining a notch in said tubular housing at said other axial end of the pump, said lug being engageable on said notch to prevent rotation of the tubular housing and stator bowl elements relative to the pump casing member; means on said pump casing member defining two axially spaced internal seating surfaces; and means on said tubular housing defining two axially spaced external seating surfaces co-operating with said internal seating surfaces to align the tubular housing within the pump casing member, said lug and notch being positioned effective to ensure that said first seating surfaces are engaged and said second seating surfaces are engaged when said notch is engaged with said lub, whereby the lining pipes act as a discharge pipe of the pump and the tubular housing is engageable in the pump casing member by movement towards said second axial end thereof and is removable by movement towards said first axial end of the pump casing member.

2. A bore hole pump assembly comprising a pump casing member having first and second ends; a bore hole lining pipe consisting of a plurality of interconnectable bore hole lining pipe sections being connectable directly to said first axial end of the pump casing member; a turbine pump having a plurality of axially spaced turbine impellers and a plurality of bowl elements interposed between said impellers and each bowl element provided with fixed vanes thereon; a drive shaft at one axial end of the pump; a tubular housing at the other axial end of the pump, the housing being engageable in the pump casing member and being removable by movement towards said one axial end, whereby the lining pipes act as a discharge pipe of the pump; and a plurality of axially spaced bearing elements supporting said drive shaft, wherein said bearing elements comprise (a) a hub having an axial bore therethrough for the passage of the drive shaft, (b) a plurality of arms extending outwardly from said hub, and (c) two fingers on the end of each arm remote from said hub, said fingers diverging one on each circumferential side of the axial radial plane of the associated arm, and said bearing elements being dimensioned whereby said fingers engage the inner wall surface of an adjacent said bore hole lining pipe section.

3. A bore hole pump assembly comprising a pump casing member having first and second axial ends; a plurality of interconnectable bore hole lining pipes, the lowermost of said pipes being connectable directly to said first axial end of the pump casing member; a turbine pump having a plurality of axially spaced turbine impellers and a plurality of stator bowl elements interposed between said impellers and each bowl element provided with fixed vanes thereon; a drive shaft at one axial end of the pump; a tubular housing at the other axial end of the pump; seating means on said tubular housing and said pump casing to enable said pump casing member to support said tubular housing;

wherein said seating means on said tubular housing and said pump casing member comprises two axially spaced internal seating surfaces on said pump casing member and two axially spaced external seating surfaces on said tubular housing co-operating with said internal seating surfaces effective to align the said tubular housing within said pump casing member; and interengageable means on the tubular housing and the pump casing member effective to hold the tubular housing non-rotatable with respect to the pump casing and to permit engagement of the tubular housing in the pump casing member by movement of the tubular housing towards said second axial end of the pump casing and removal of the tubular housing from the pump casing member by movement of the tubular housing towards said first axial end, whereby the lining pipes act as a discharge pipe of the pump.

4. A bore hole pump assembly comprising a pump casing member; a plurality of interconnectable bore hole lining pipes, the lower most of said pipes being connectable directly to one axial end of the casing member; a turbine pump having a plurality of axially spaced turbine impellers and a plurality of stator bowl elements interposed between said impellers and each bowl element provided with fixed vanes thereon; a drive shaft at one axial end of the pump; a tubular housing at the other axial end of the pump; means defining two axially spaced internal seating surfaces on said pump casing member, means defining two axially spaced external seating surfaces on said tubular housing and co-operating with said internal seating surfaces of said pump casing member effective to align the tubular housing within said pump casing member, the housing being engageable in the pump casing member and being removable by movement towards said one axial end, whereby the lining pipes act as a discharge pipe of the pump.

5. An assembly as claimed in claim 4, wherein said drive shaft consists of a plurality of interengageable shaft sections and further comprising a drive motor and a collet connector associated with said drive motor, effective to permit axial positioning of said pump elements.

6. An assembly as claimed in claim 4, wherein the diameter of the seating surface remote from said one axial end of the pump is smaller than that of the other seating surface.

7. An assembly as claimed in claim 6, wherein seating surfaces are both cylindrical.

* * * * *